US012480732B1

(12) United States Patent
Schiedeman et al.

(10) Patent No.: US 12,480,732 B1
(45) Date of Patent: Nov. 25, 2025

(54) GUN STOCK CATCH

(71) Applicants: Kyle Schiedeman, Evergreen, OK (US); Ryan T. Cowgill, Fruitland, ID (US)

(72) Inventors: Kyle Schiedeman, Evergreen, OK (US); Ryan T. Cowgill, Fruitland, ID (US)

(73) Assignee: SHEEPDOG KIT, LLC, Evergreen, CO (US)

( * ) Notice: Subject to any disclaimer, the term of this patent is extended or adjusted under 35 U.S.C. 154(b) by 0 days.

(21) Appl. No.: 18/798,564

(22) Filed: Aug. 8, 2024

Related U.S. Application Data

(60) Provisional application No. 63/531,483, filed on Aug. 8, 2023.

(51) Int. Cl.
*F41A 23/16* (2006.01)

(52) U.S. Cl.
CPC ..... *F41A 23/16* (2013.01)

(58) Field of Classification Search
CPC .... F41C 33/001; F41C 33/003; F41C 33/002; F41A 23/16; F41A 23/52
See application file for complete search history.

(56) References Cited

U.S. PATENT DOCUMENTS 476,246 A * 6/1892 Burgess ..... F41A 9/18 42/74
1,519,123 A * 12/1924 Edwards ..... A41D 13/0012 2/94
3,708,801 A * 1/1973 Davis ..... F41C 33/001 224/149
4,243,165 A * 1/1981 Schuler ..... F41C 33/001 2/94
4,642,815 A 2/1987 Allen
5,528,846 A 6/1996 Beggett
5,629,673 A 5/1997 Johasz
6,250,009 B1 6/2001 Leontuk
8,051,596 B1 11/2011 Thomas, Jr.
(Continued)

FOREIGN PATENT DOCUMENTS

EP 3401630 5/2018

OTHER PUBLICATIONS

Magpul, "Magpul CTR Stock Install Instructions", Unknown, Publisher: www.magpul.com.

*Primary Examiner* — Joshua E Freeman
(74) *Attorney, Agent, or Firm* — James F. Lea, III; Gable Gotwals

(57) ABSTRACT

A shooting pocket for stabilizing a firearm includes a frame for securing to equipment worn by a shooter. A pivot plate is pivotally mounted to the frame. A receiving area receives a buttstock of a firearm and pivots with the pivot plate to facilitate directional manipulation and aiming of the firearm. The pivot plate defines a pivot ball support surrounding a central orifice on the inner facing side. The pivot ball support defines a pivot ball engaging surface wherein the pivot ball engaging surface defines a second plane that is offset from the first plane by 30 to 10 degrees. An inner facing said of a catch plate has mating engagement with the outer facing side of the pivot plate. The inner facing side of the catch plate defines a concave pivot ball rotation member a pivot ball. A biasing member returns the pivot plate to a predetermined position.

25 Claims, 16 Drawing Sheets

(56) References Cited

U.S. PATENT DOCUMENTS

| | | | | |
|---|---|---|---|---|
| 8,056,778 | B1 | 11/2011 | Michaux | |
| 8,215,045 | B2 * | 7/2012 | Mitchell | F41C 23/20 42/72 |
| 8,484,878 | B2 | 7/2013 | Borkowski | |
| 8,613,564 | B2 * | 12/2013 | Busch | F16B 21/09 403/328 |
| 8,640,932 | B2 | 2/2014 | Dalton et al. | |
| 8,813,408 | B1 * | 8/2014 | Knight, Sr. | F16M 13/04 224/149 |
| 8,910,410 | B2 * | 12/2014 | Peters | F41C 33/006 224/271 |
| 8,943,730 | B2 * | 2/2015 | Ascano | F41C 33/007 42/94 |
| 9,297,610 | B2 | 3/2016 | Borkowski et al. | |
| 9,335,112 | B1 * | 5/2016 | Sholley | F41A 23/06 |
| 9,726,450 | B2 | 8/2017 | Borkowski et al. | |
| 9,765,806 | B2 | 9/2017 | Busch | |
| 10,434,371 | B2 * | 10/2019 | Shoffler | A63B 22/18 |
| 11,585,634 | B2 | 2/2023 | Wessels et al. | |
| 2002/0036219 | A1 | 3/2002 | Neighbors | |
| 2009/0229160 | A1 * | 9/2009 | Elliott | F41A 23/04 42/71.01 |
| 2010/0051656 | A1 * | 3/2010 | McCarty | F41C 23/02 224/183 |
| 2010/0107466 | A1 | 5/2010 | Whittle | |
| 2011/0083353 | A1 * | 4/2011 | Mitchell | F41C 33/001 29/527.1 |
| 2011/0131860 | A1 | 6/2011 | Borkowski | |
| 2012/0266352 | A1 * | 10/2012 | Busch | F41C 33/007 403/375 |
| 2012/0279108 | A1 | 11/2012 | Dalton et al. | |
| 2013/0276343 | A1 | 10/2013 | Peters | |
| 2014/0086675 | A1 | 3/2014 | Busch | |
| 2014/0190054 | A1 | 7/2014 | Ascano | |
| 2014/0223796 | A1 | 8/2014 | Coonrod | |
| 2015/0040457 | A1 | 2/2015 | Borkowski et al. | |
| 2016/0209156 | A1 | 7/2016 | Borkowski et al. | |
| 2019/0368839 | A1 * | 12/2019 | Schiedeman | F41A 23/52 |
| 2022/0299020 | A1 * | 9/2022 | Steele | F04B 47/12 |

* cited by examiner

GUN STOCK CATCH

CROSS REFERENCE TO RELATED APPLICATIONS

This application claims the priority of U.S. Provisional Patent Application No. 63/531,483 titled "GUN STOCK CATCH," filed Aug. 8, 2023, the contents of which are hereby incorporated by reference.

FIELD OF THE INVENTION

The present invention relates to a shooting pocket/platform for receiving a butt of a gun for stabilizing a firearm.

BACKGROUND OF THE INVENTION

In a profession that utilizes firearms and ballistic plates, e.g., military, law enforcement or other professions, users have likely experienced the butt-stock of a long gun sliding on the ballistic plate upon firing of a round. This movement may result in a user's loss of sights, a subsequent scramble to find the sight, and reacquire a target.

Shooting with ballistic plates takes away the natural shooting pocket formed between a user's shoulder, chest and cheek. Many shooters learn to compensate while shooting with plates.

At one time, ballistic plates were utilized only by the military. Now, law enforcement tactical teams use ballistic plates. Additionally, with the threats faced daily by law enforcement from criminals, active shooters and terrorists, ballistic plates and long guns are being issued to everyone from school resource officers to patrol officers to line federal agents. This trend is only going to continue.

Ballistic plates cause issues with long gun shooters. The extra weight, the decrease in mobility, the loss of the natural shooting pocket, all result in lowered confidence, and, in turn, fewer effective rounds on target.

SUMMARY OF THE INVENTION

The device of the invention gives a shooter the shooting pocket that ballistic plates take away. Ballistic armor may be "soft armor" of the type that regular police use every day or it may be hard body armor, e.g., ballistic plates, or a combination of the two. The soft and hard body armor is typically contained or sheathed in what is referred to as, "tactical nylon" or sometimes is referred to as a "carrier".

A device of the invention is used to create a shooting pocket or platform for stabilization, accuracy and support while firing a firearm. In one embodiment, the device attaches to the carrier of ballistic armor, i.e., the device creates a shooting pocket to replace a shooter's natural shooting pocket that is inaccessible due to the armor. For purposes of this application, "equipment" refers to the carrier that contains or sheaths the body armor, but may also refer to a separate article, e.g., a cover or harness, that could be worn in addition to the body armor, i.e., "equipment" may refer to the carrier that typically carries the body armor and, in one embodiment, also carries or supports the device of the invention, and "equipment" also refers to an article that may be worn in addition to body armor to support the device of the invention. includes a body armor/plate carrier by P.A.L.S. (Pouch Attachment Ladder System) clips or a hook and loop shoulder strap attached to a frame. The device may further be secured by an anchor strap. The anchor strap secures to the frame of the device. The device is designed to be utilized when the body armor/plate carrier contains ballistic plates but will function without them.

Once the device is attached to equipment, e.g., to the body armor/plate carrier, straps, or a jacket, the device receives the buttstock of a long gun into a catch plate. Different catch plates design may be provided for different buttstock models. The catch plate is removable and is selected to receive an appropriate buttstock model.

Once a buttstock is seated into the catch plate, a long gun can be securely articulated in an arc of motion by means of a pivot ball. The device secures the long gun to a wearer's equipment, e.g., to body armor, allowing for increased accuracy when firing by means of providing a stable pocket/platform. The device unloads a portion of the weight of the long gun, thereby diminishing fatigue of the shooter. The long gun will disengage from the device by simply lowering the gun or by dropping the gun free. A catch plate constantly returns to a starting position by means of a biasing member, such as an index cord.

One purpose of the device is to provide a shooting (shoulder) pocket, which is eliminated by ballistic plates and bulky body armor.

In greater detail, a shooting pocket/platform for stabilizing a firearm includes a frame defining a front side and a rear side. The frame is adapted for securing to equipment worn by a shooter, such as body armor, a harness, a jacket or other equipment.

A pivot plate is pivotally mounted with respect to the frame. The pivot plate defines an outer facing side and an inner facing side. A receiving area is provided for selectively receiving a buttstock of a firearm, such as a long gun. The receiving area is adapted to pivot with the pivot plate to facilitate directional manipulation of the firearm for aiming the firearm.

In one embodiment, the frame defines strap receiving areas for receiving straps to secure the frame to equipment worn by the shooter.

In one embodiment, a pivot ball post extends from the front side of the frame. The pivot ball post defines a terminal end.

In one embodiment, a travel stop extends from the front side of the frame for limiting a range of movement of the pivot plate.

In one embodiment, the inner facing side of the pivot plate defines a first plane, and a central orifice. The pivot plate defines a pivot ball support surrounding the central orifice on the inner facing side. The pivot ball support defines a pivot ball engaging surface for receiving a pivot ball.

In one embodiment, the pivot ball engaging surface defines a second plane that is offset from the first plane by 30 to 10 degrees, by 25 to 15 degrees, by approximately 20 degrees.

In one embodiment, a catch plate defines an outwardly facing side and an inner facing side, wherein the inner facing side of the catch plate for mating engagement with the outer facing side of the pivot plate.

In one embodiment, the inner facing side of the catch plate defines a pivot ball rotation member having a concave surface for receiving the pivot ball.

In one embodiment, the outer facing side of the catch plate defines a plurality of buttstock anti-slip features for engaging a buttstock of a firearm.

In one embodiment, the catch plate has a right buttstock heel hook extending from the outwardly facing side and defines a terminal end. The catch plate has a left buttstock heel hook extending from the outwardly facing side and defines a terminal end. The right buttstock heel hook may have a right lateral stability wall and a buttstock rest support extending upward from the terminal end of the right buttstock heel hook, and the left buttstock heel hook may have a left lateral stability wall and a buttstock rest support extending upward from the terminal end of the left buttstock heel hook.

In one embodiment, a pivot ball is located adjacent to the central orifice of the pivot plate, wherein the pivot ball defines a top pivot surface and a bottom pivot surface.

In one embodiment, a catch plate defines an inner facing side, and the inner facing side of the catch plate defines a pivot ball rotation member having a concave surface. The top pivot surface of the pivot ball in located in sliding engagement with the pivot ball rotation member of the catch plate.

In one embodiment, a biasing member is provided for returning the pivot plate to a pre-determined position. In one embodiment, the biasing member is an index cord passing through at least one index cord passthrough defined by the frame and engaging at least one index cord passthrough defined by the pivot plate for elastically biasing the pivot plate in a pre-determined orientation with respect to the frame about a pivot ball.

The device increases accuracy.

The device stabilizes a shooter's aim, thereby facilitating quicker repeat shots, e.g., by eliminating slipping on the ballistic plate or tactical nylon.

The device takes weight off the gun, on the line or while holding cover, e.g., hallways, doors, tree lines.

The device increases a shooter's ability to shoot on the move by ensuring that the buttstock is set to the shooter's chest.

The device vastly improves weapon manipulation/accuracy for smaller framed shooters.

The device allows for quicker uptake of shooting skills by novices.

The device is simple and low tech, e.g., the device may be constructed of 4 pieces of glass filled nylon, 5 screws and a piece of 550 cord.

The device is beneficial for anyone who shoots an AR/M4 platform while utilizing body armor with ballistic plates or plate carriers.

The device of the disclosure may attach to either a shoulder strap or a MOLLE, according to a shooter's preference. Testing indicates that 70% prefer the shoulder strap to 30% prefer the MOLLE for attachments.

DETAILED DESCRIPTION OF THE PREFERRED EMBODIMENTS

Figure 3:
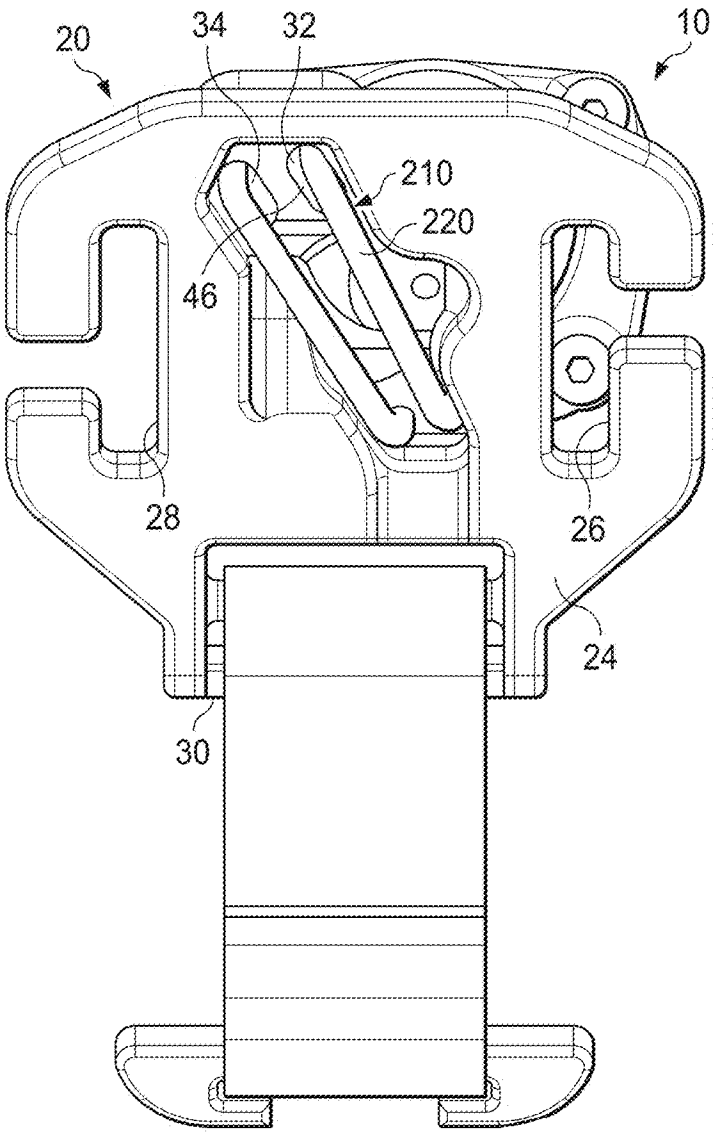
FIG. 3 is a rear elevation view of the assembled device of FIG. 1.
Figure 2:
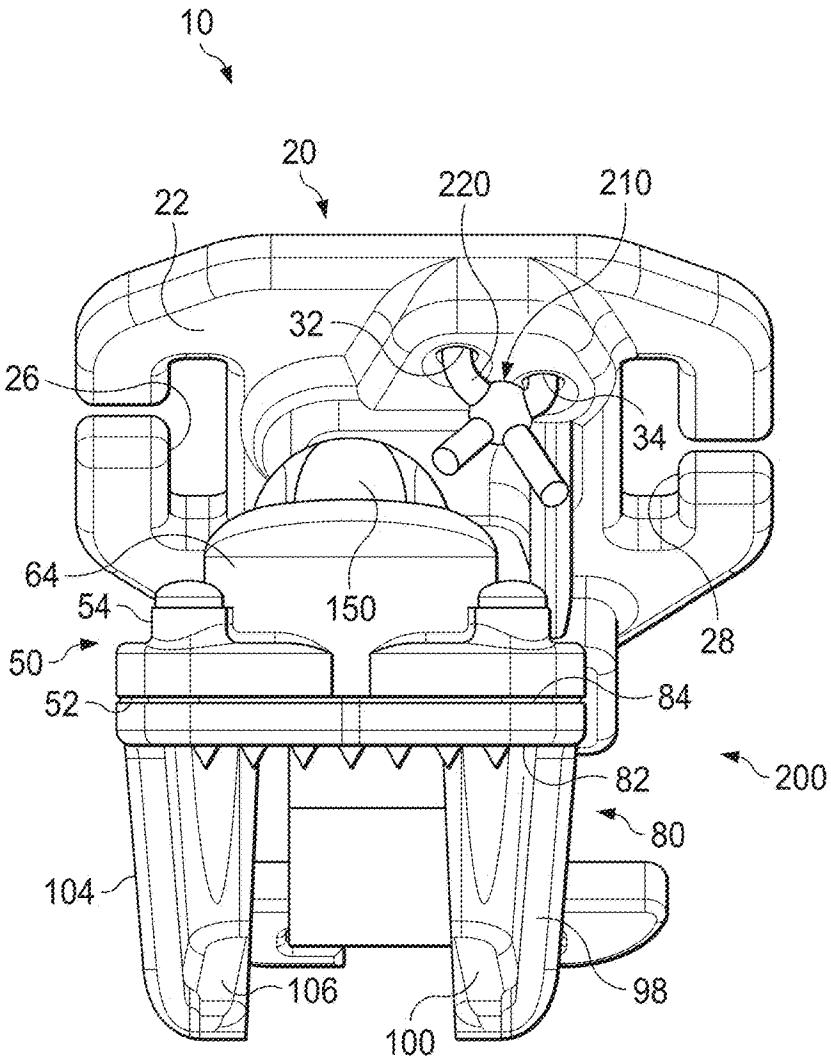
FIG. 2 is a top view of the assembled device of FIG. 1.
Figure 4:
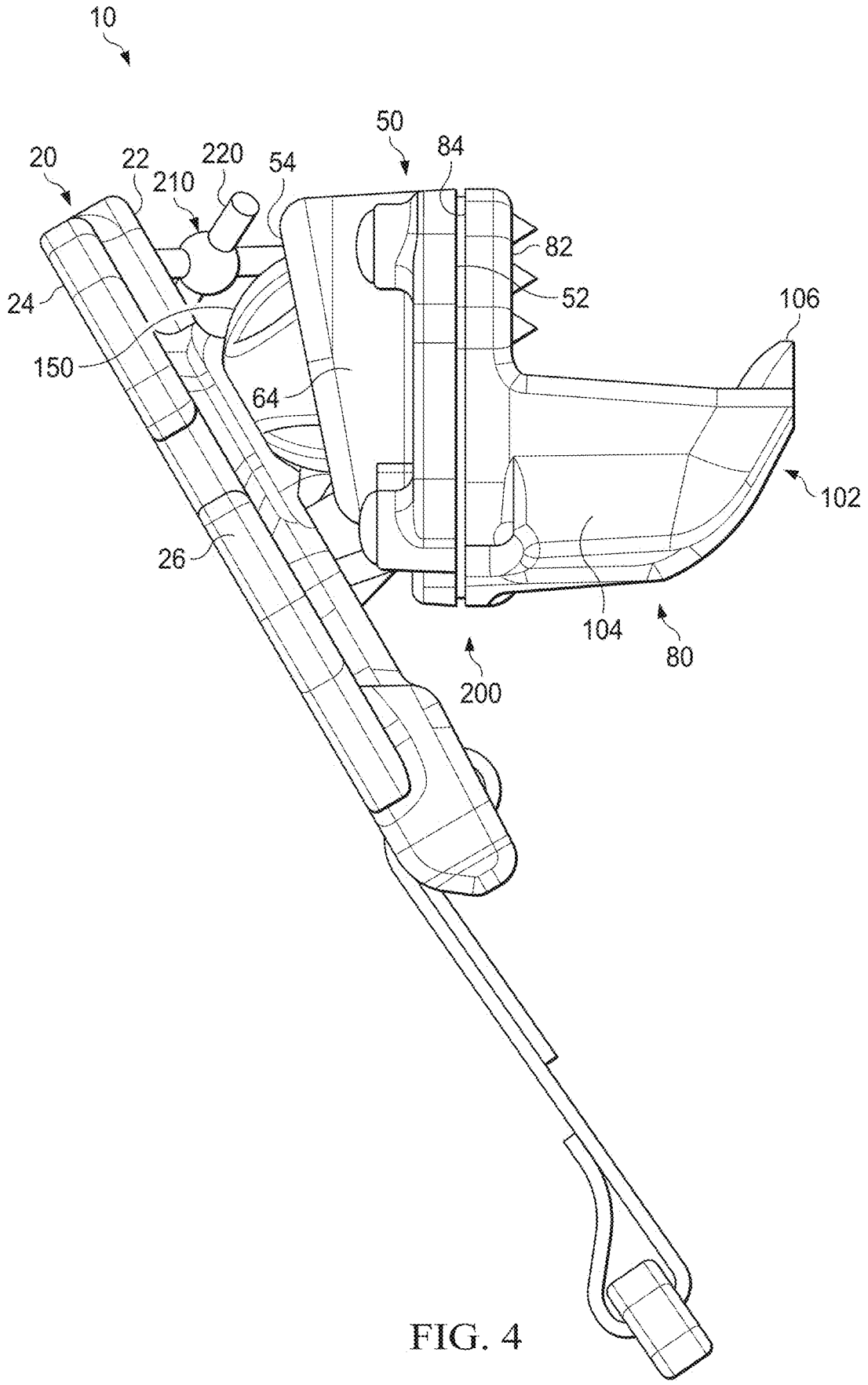
FIG. 4 is a side elevation view of the assembled device of FIG. 1.
Figure 5:
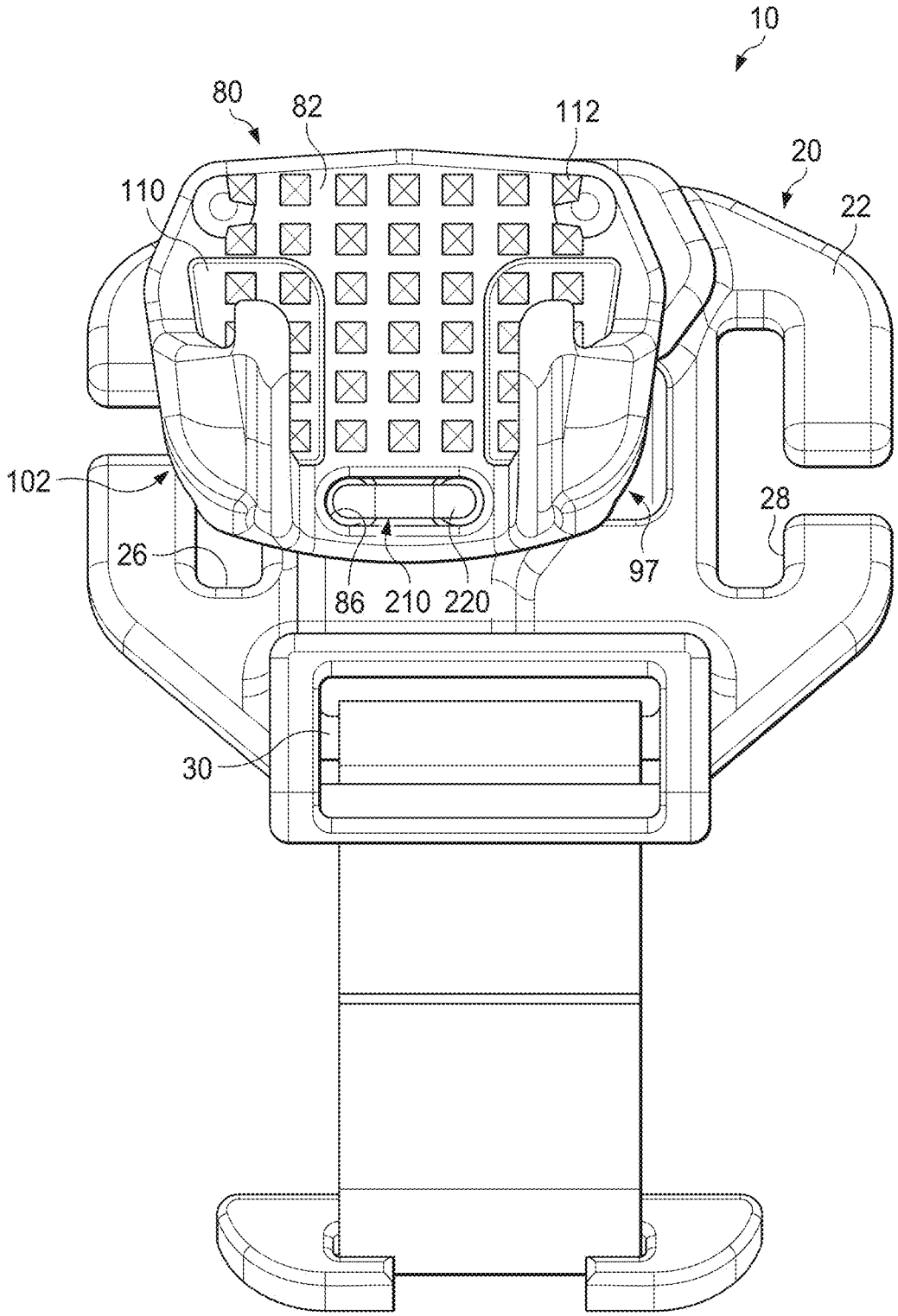
FIG. 5 is a front elevation view of the assembled device of FIG. 1.
Figure 8:
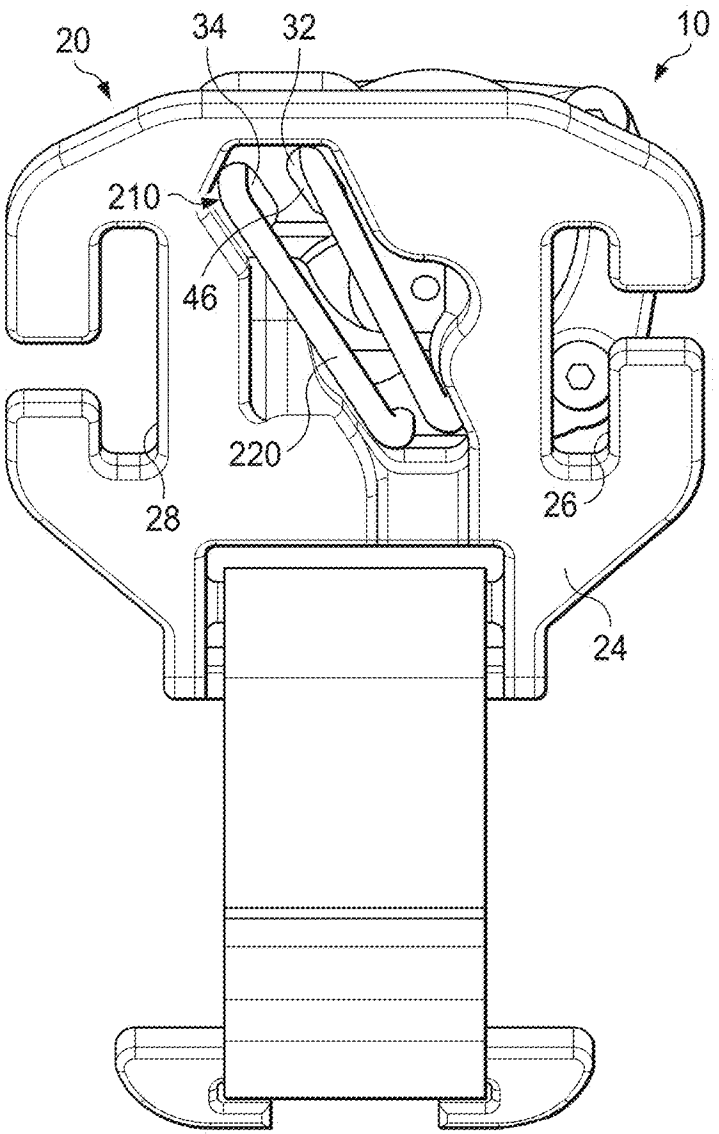
FIG. 8 is a rear elevation view of the assembled device of FIG. 6.
Figure 7:
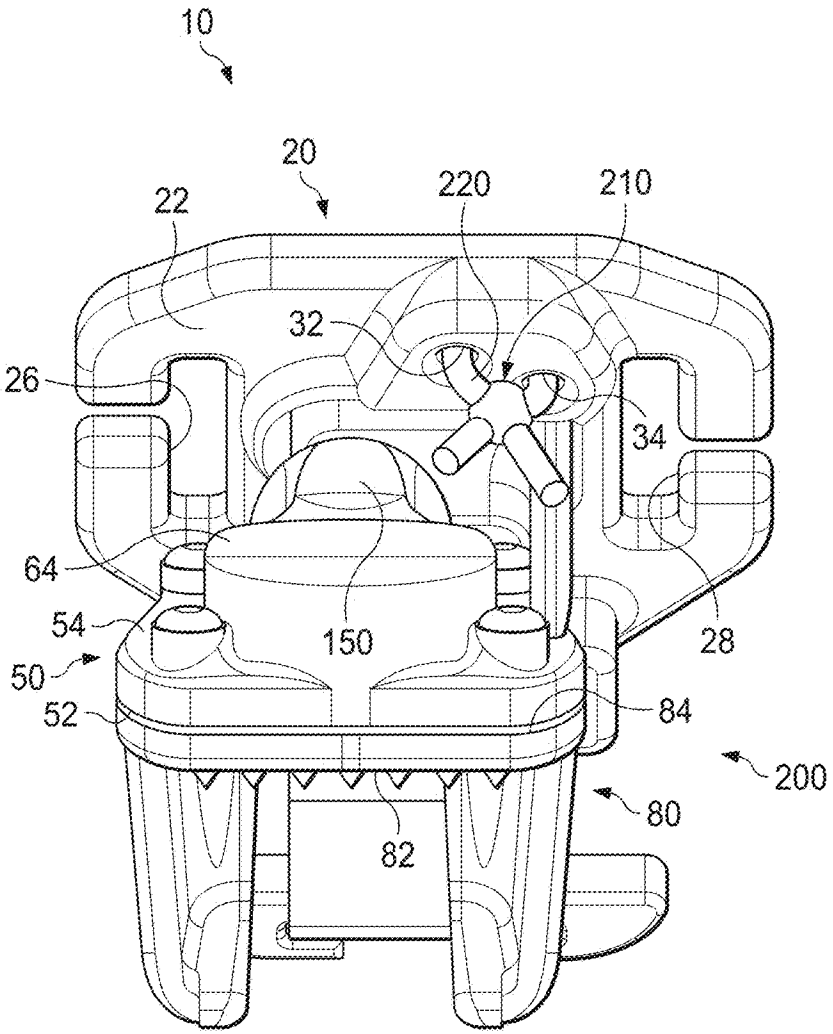
FIG. 7 is a top view of the assembled device of FIG. 6.
Figure 10:
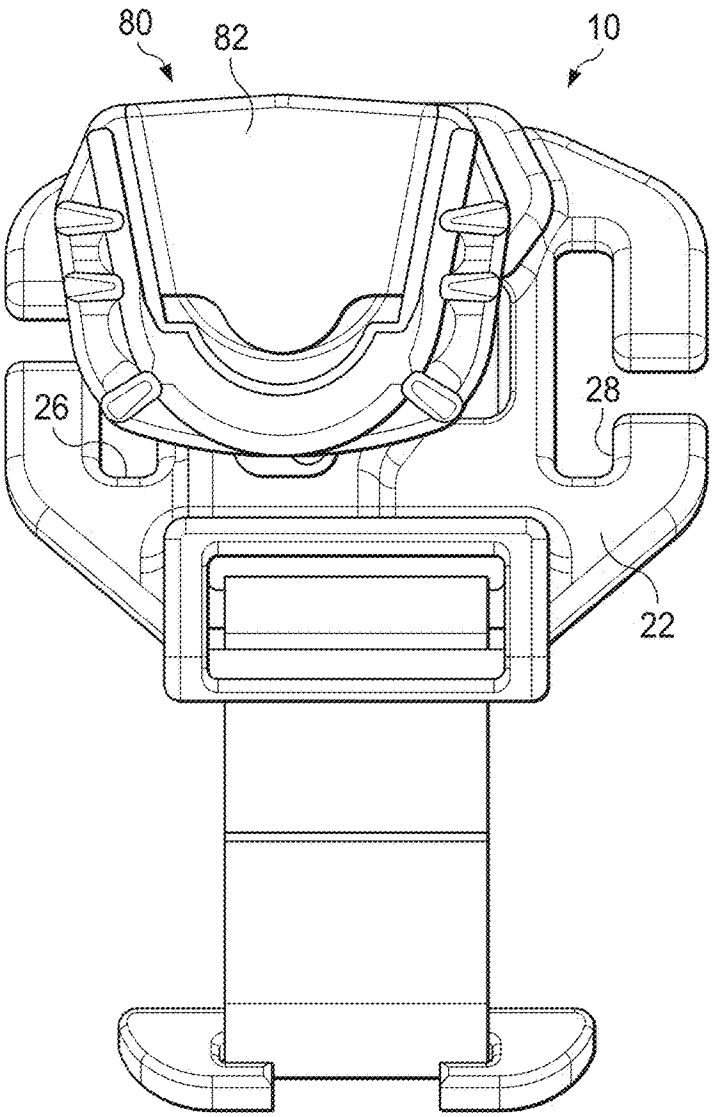
FIG. 10 is a front elevation view of the assembled device of FIG. 6.
Figure 9:
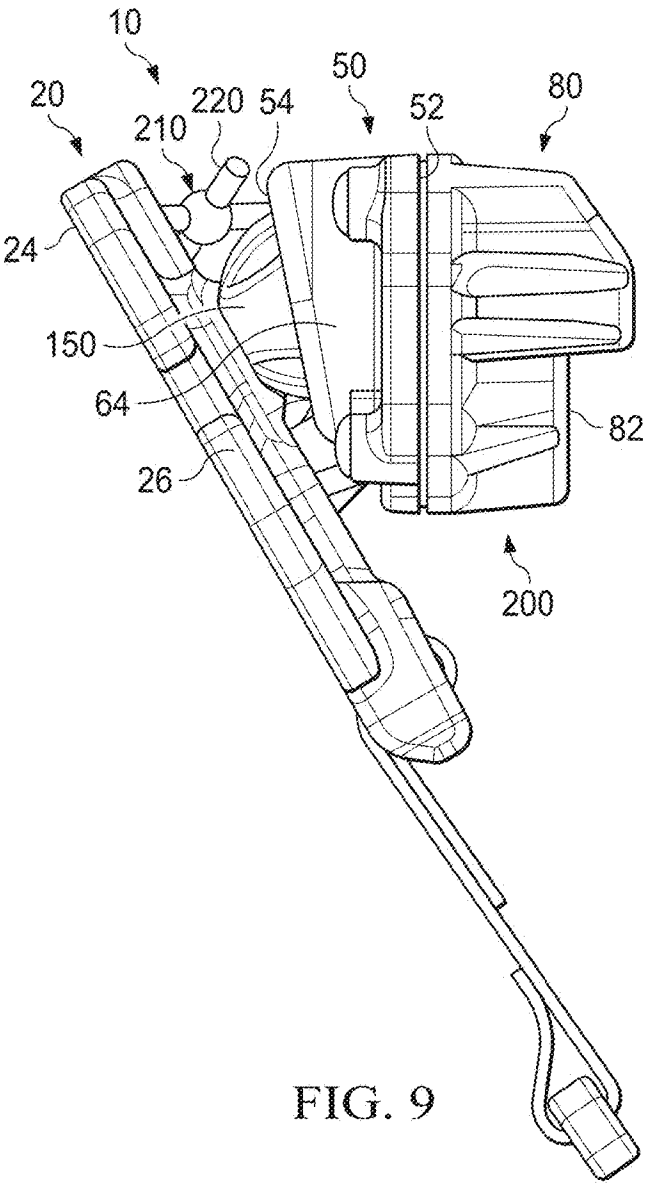
FIG. 9 is a side elevation view of the assembled device of FIG. 6.
Figure 11:
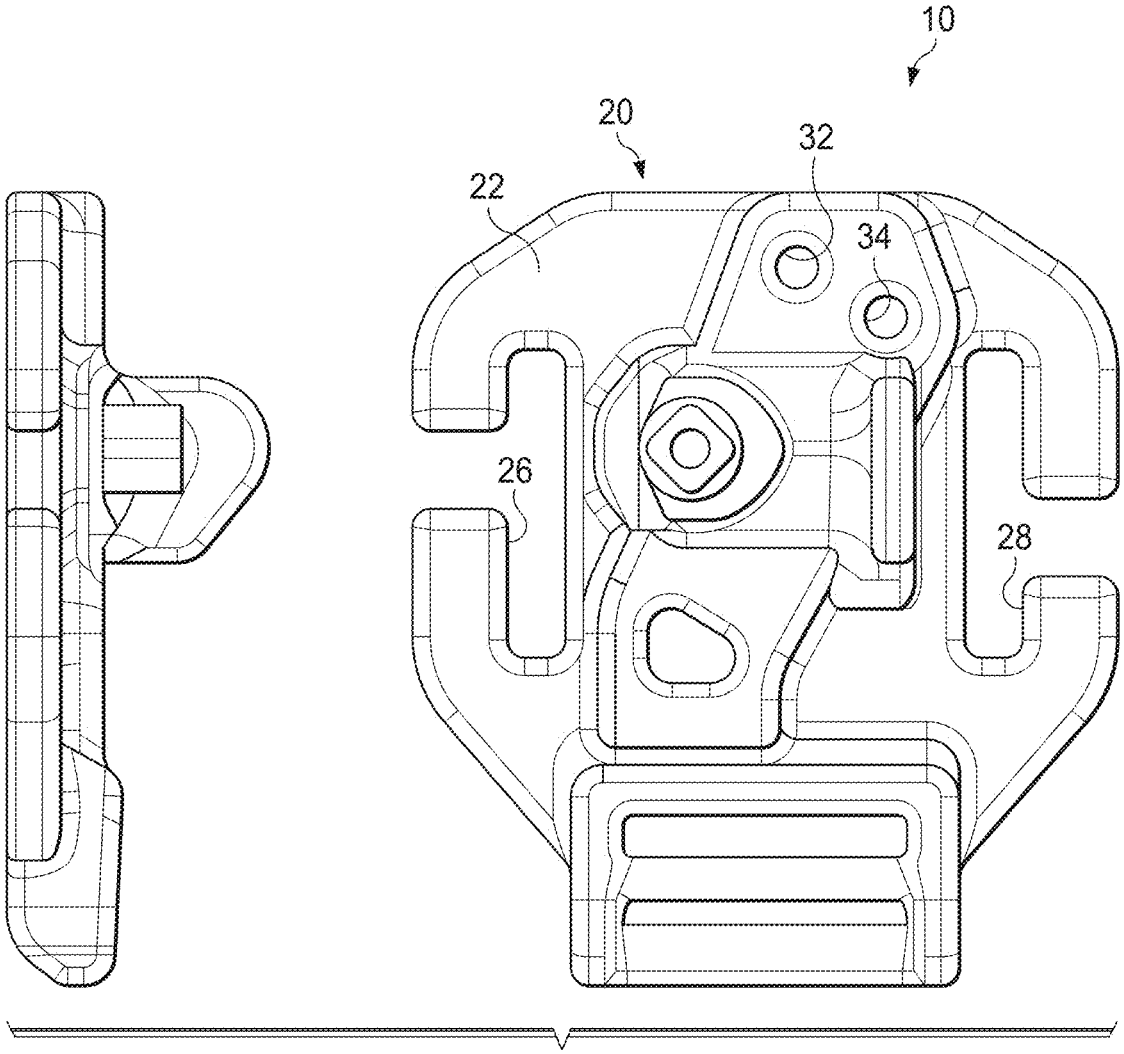
FIG. 11 is front plan view of the frame of FIG. 1.
Figure 12:
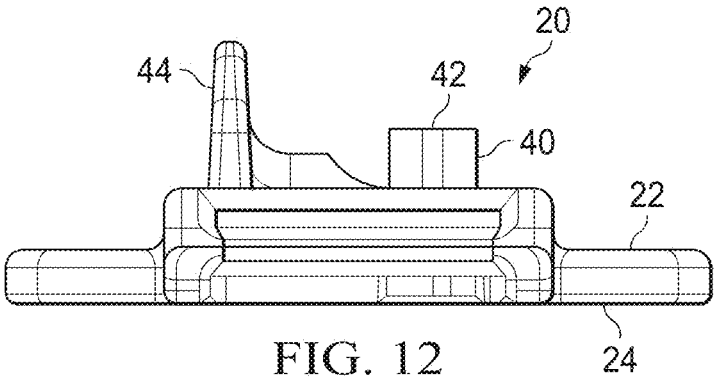
FIG. 12 is top view of the frame of FIGS. 1 and 6.

Referring now to the Figures, shown is a shooting pocket or platform designated generally 10. Shooting platform 10 is for stabilizing a firearm. Shooting platform 10 includes a frame 20, wherein frame 20 defines a front side 22, a rear side 24, a first strap receiving area 26, a second strap receiving area 28, and a third strap receiving area 30. Frame 20 defines a first upper index cord pass through 32, second upper index cord pass through 34, and lower index cord pass through 36. Frame 20 preferably defines pivot ball post 40 extending from front side 22 of frame 20. Pivot ball post 40 defines terminal end 42 (FIG. 12). Travel stop 44 extends from front side 22 of frame 20. Rear side 24 of frame 20 defines attachment channel 46 (FIGS. 3, 8) located between first upper index cord pass through 32 and second upper index cord pass through 34.

Figure 13A:
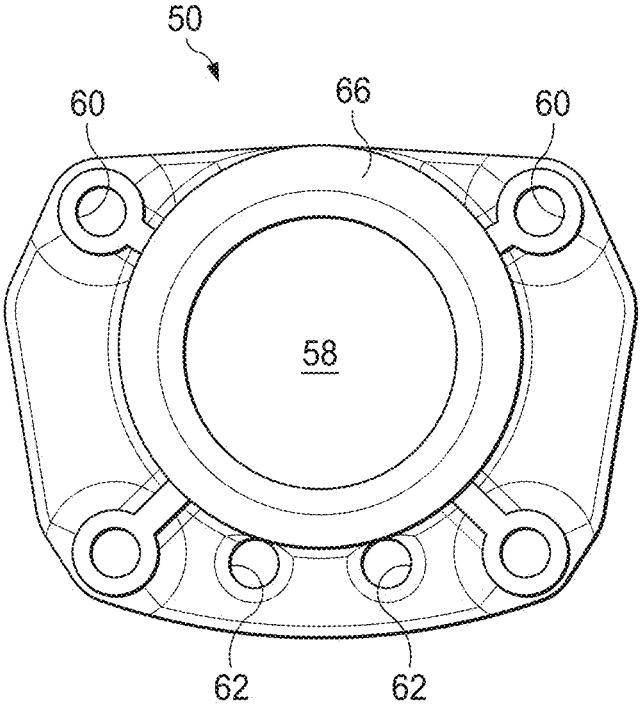
FIG. 13A is an elevation view of an inner facing side of a pivot plate of FIGS. 1 and 6.
Figure 13B:
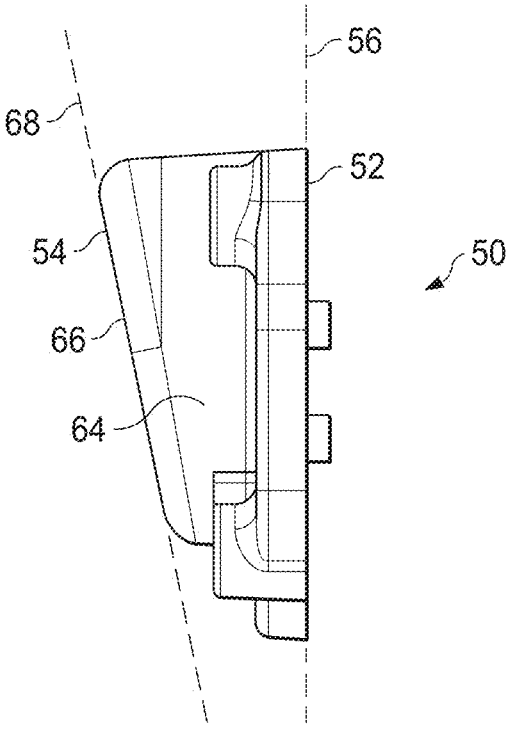
FIG. 13B is a side elevation view of the pivot plate.
Figure 13C:
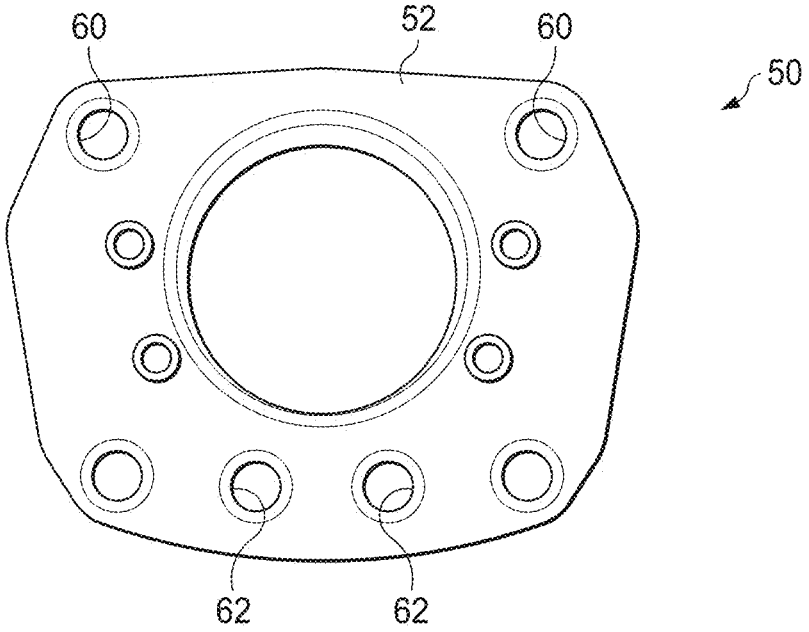
FIG. 13C is a plan view of an outer facing side of the pivot plate.
Figure 13D:
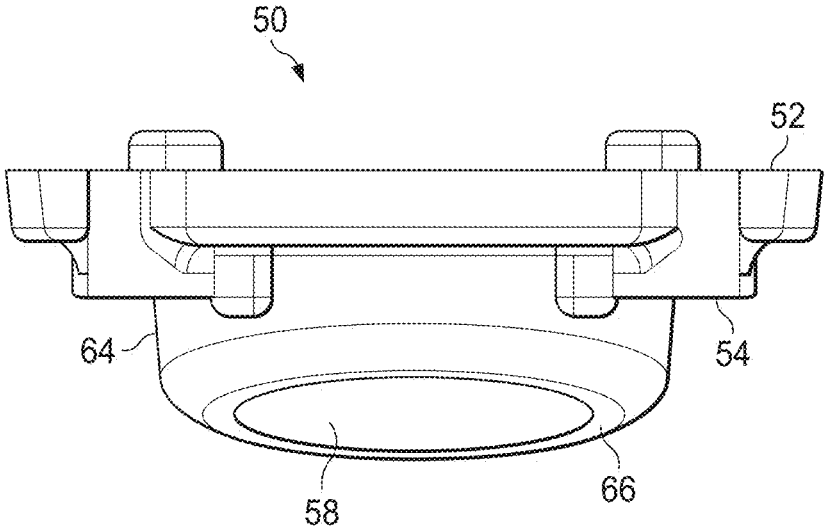
FIG. 13D is an end perspective view of the pivot plate.

Shooting platform 10 additionally includes pivot plate 50. Pivot plate 50 defines outer facing side 52 and inner facing side 54. Inner facing side 54 defines first plane 56 (FIG. 13B). Pivot plate 50 defines central orifice 58 (FIGS. 13A, 13C, 13D), screw bosses 60 (FIGS. 13A, 13C) and index cord pass through 62 (FIGS. 13A, 13C). Pivot plate 50 defines pivot ball support 64 that surrounds central orifice 58 on inner facing side 54. Pivot ball support 64 defines a pivot ball engaging surface 66 (FIGS. 13A, 13B, 13D). Pivot ball engaging surface 66 defines second plane 68 (FIG. 13B) that is offset from first plane 56. In one embodiment, second plane 68 is offset from first plane 56 by between 30 and 10 degrees. In one embodiment, second plane 68 is offset from first plane 56 by 25 to 15 degrees. In one embodiment, second plane 68 is offset from first plane 56 by approximately 20 degrees.

Figure 14A:
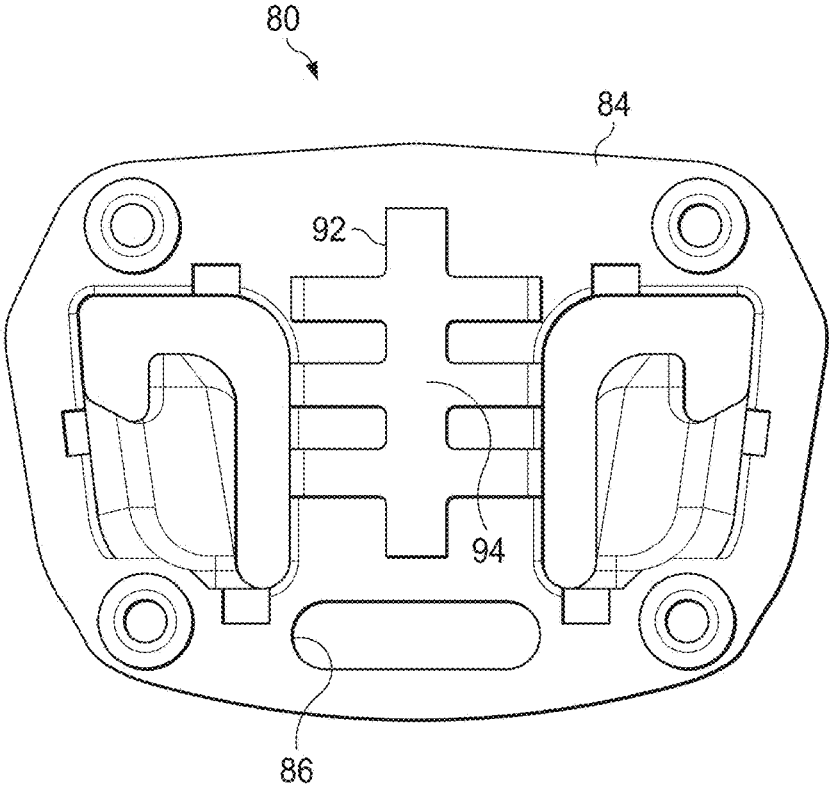
FIG. 14A is an elevation view of an inner facing side of a catch plate of FIGS. 1 and 6.
Figure 14B:
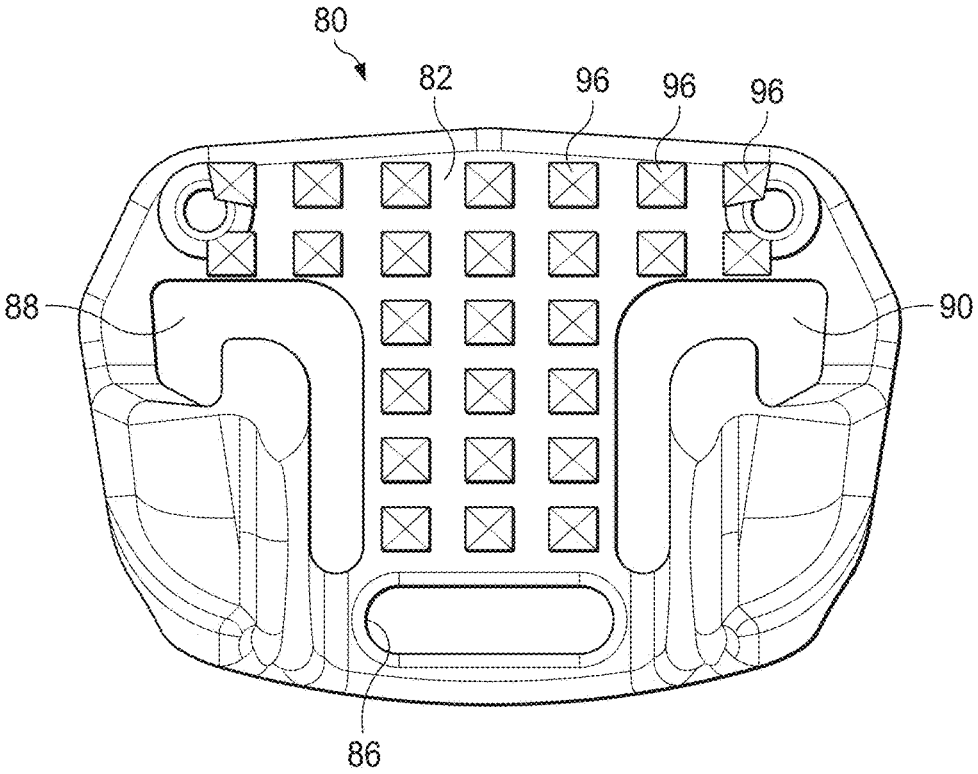
FIG. 14B is an elevation view of an outwardly facing side of the catch plate.
Figure 14C:
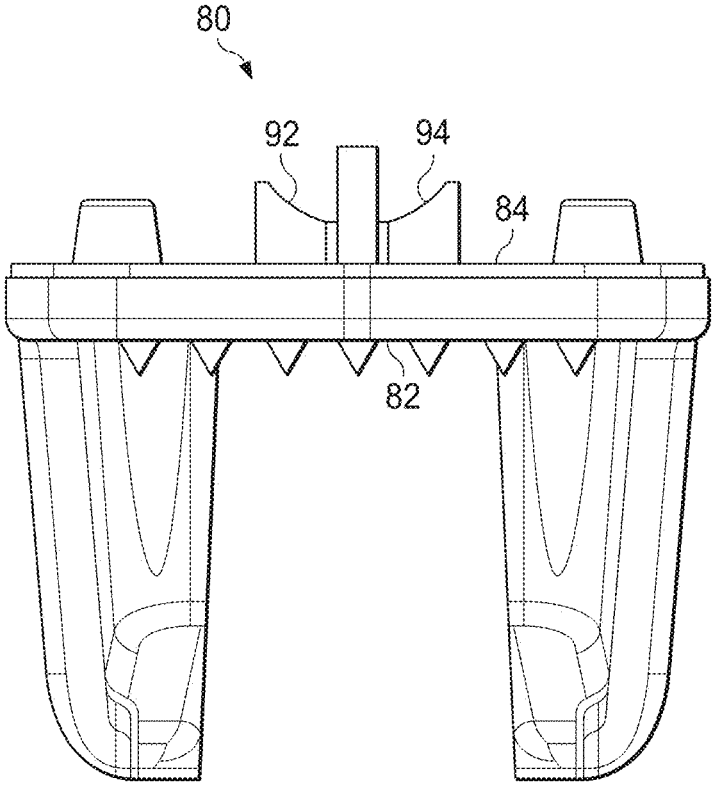
FIG. 14C is a plan view of the catch plate.
Figure 14D:
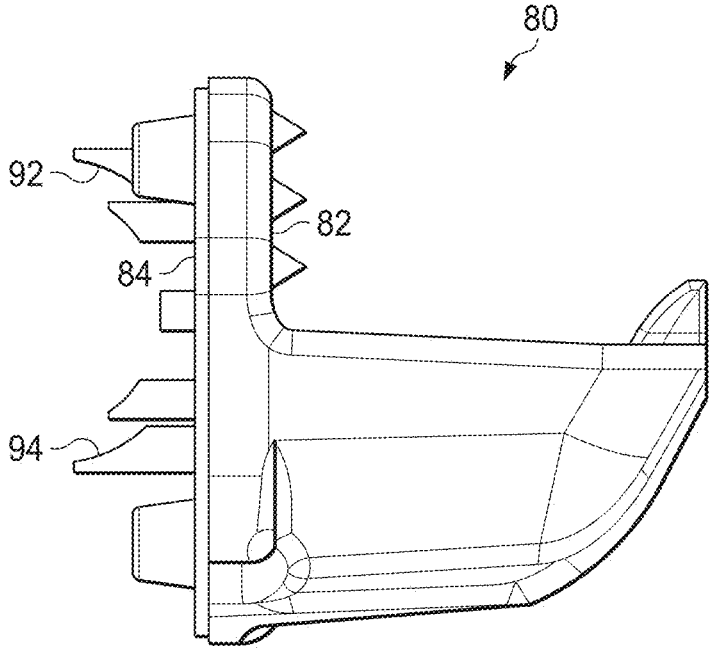
FIG. 14D is a side elevation view of the catch plate.

Shooting platform 10 further includes catch plate 80. Catch plate 80 defines outwardly facing side 82, inwardly facing side 84, and defines index cord pass through 86. In one embodiment, outwardly facing side 82 defines left recess 88 and right recess 90 (FIG. 14B). Inner facing side 84 of catch plate 80 is for mating engagement with outer facing side 52 of pivot plate 50. Inner facing side 84 of catch plate 80 defines pivot ball rotation member 92 (FIGS. 14A, 14C, 14D). Pivot ball rotation member 92 preferably defines concave surface 94. Outwardly facing side 82 of catch plate 80 preferably defines a plurality of butt stock anti-slip features 96 (FIG. 14B). In one embodiment, catch plate 80 has a right butt stock heel hook 97 extending from outwardly facing side 82. Right butt stock heel hook 97 preferably has a right lateral stability wall 98 and a butt stock rest support 100 that extends upwardly from a terminal end of right lateral stability wall 98. Catch plate 80 additionally may be provided with left butt stock heel hook 102 that extends from outwardly facing side 82. Left butt stock heel hook 102 has a left lateral stability wall 104 and a butt stock rest support 106 that extends upwardly from a terminal end of left lateral stability wall 104.

In another embodiment, (see, e.g., FIG. 6) e.g., an "M4" version", catch plate 80 defines a right lateral stability wall 98, a left lateral stability wall 104, and a lower buttstock support 108.

Figure 1:
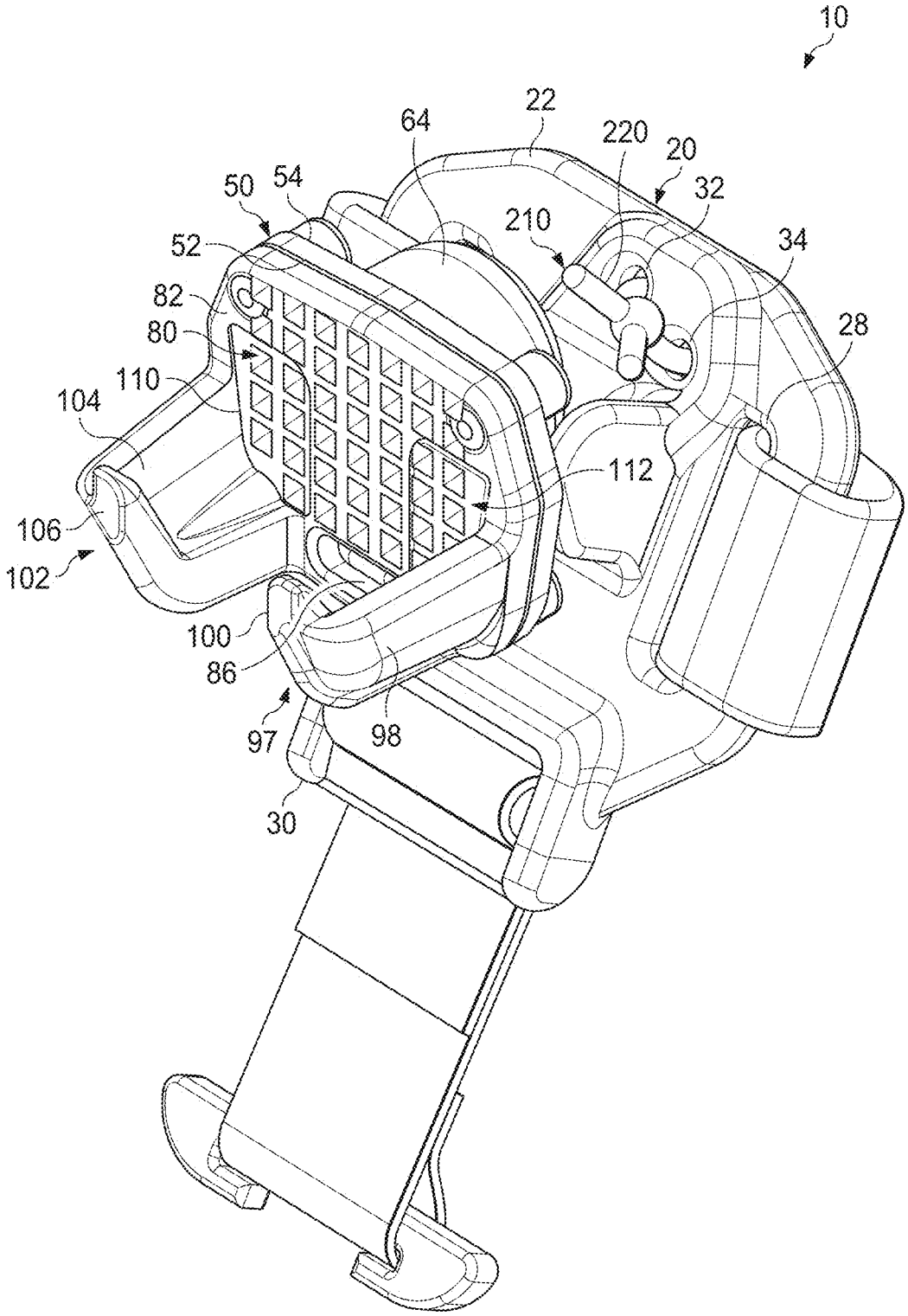
FIG. 1 is a perspective view of an assembled device utilizing a catch plate adapted to receive a magpul buttstock.
Figure 6:
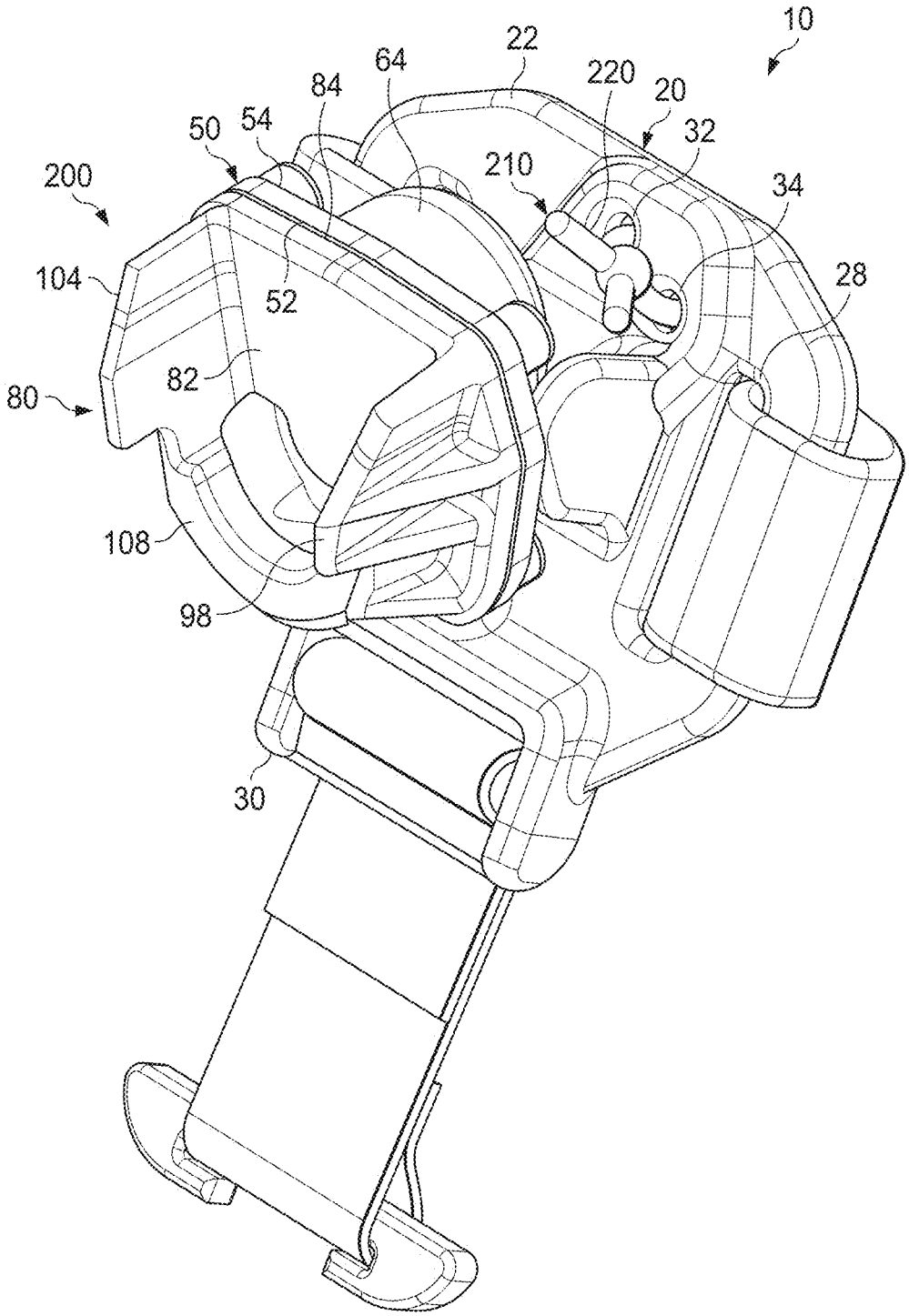
FIG. 6 is a perspective view of an assembled device utilizing a catch plate adapted to receive a M4 buttstock.

The embodiment of catch plage 80 shown in FIGS. 1 and 6 are exemplary. Other constructions designed to receive buttstocks of other guns are also possible.

In one embodiment, left catch plate insert 110 may be sized to be received within left recess 88 of outwardly facing side 82 of catch plate 80. Additionally, right catch plate insert 112 may be sized to be received in right recess 90 of outwardly facing side 82 of catch plate 80.

Figure 15A:
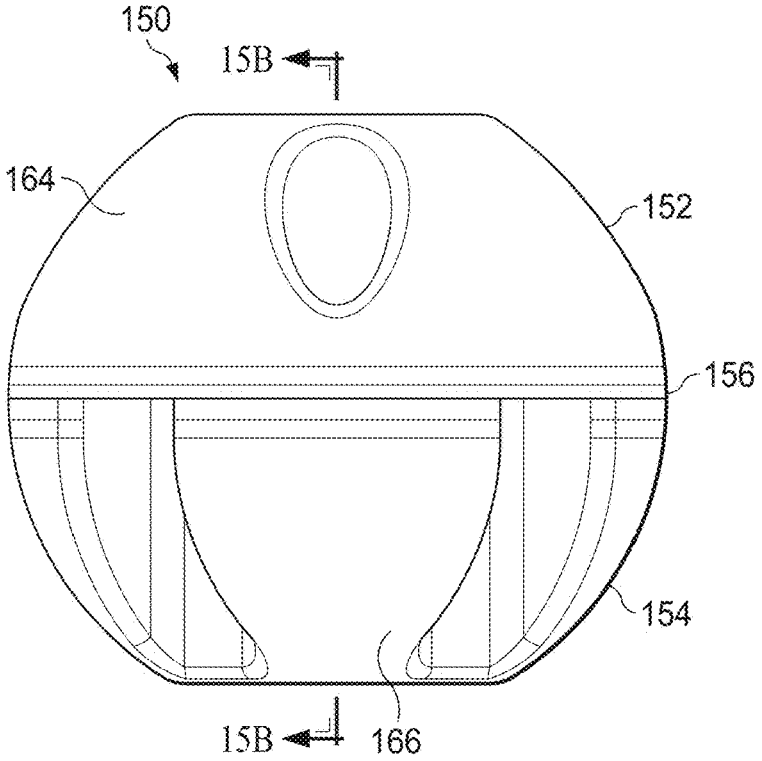
FIG. 15A is an elevation view of the pivot ball of FIGS. 2, 4, 7, and 9.
Figure 15B:
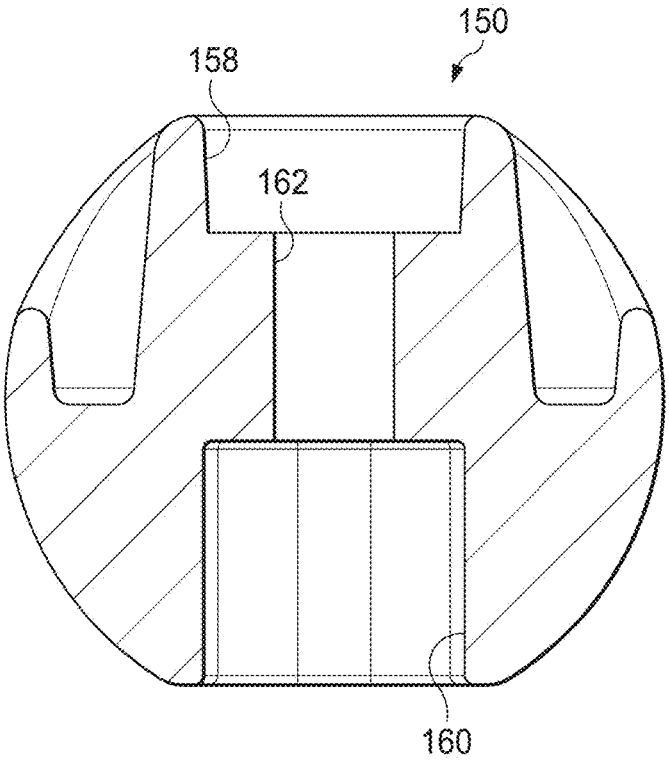
FIG. 15B is a cross-sectional view of the pivot ball.
Figure 16B:
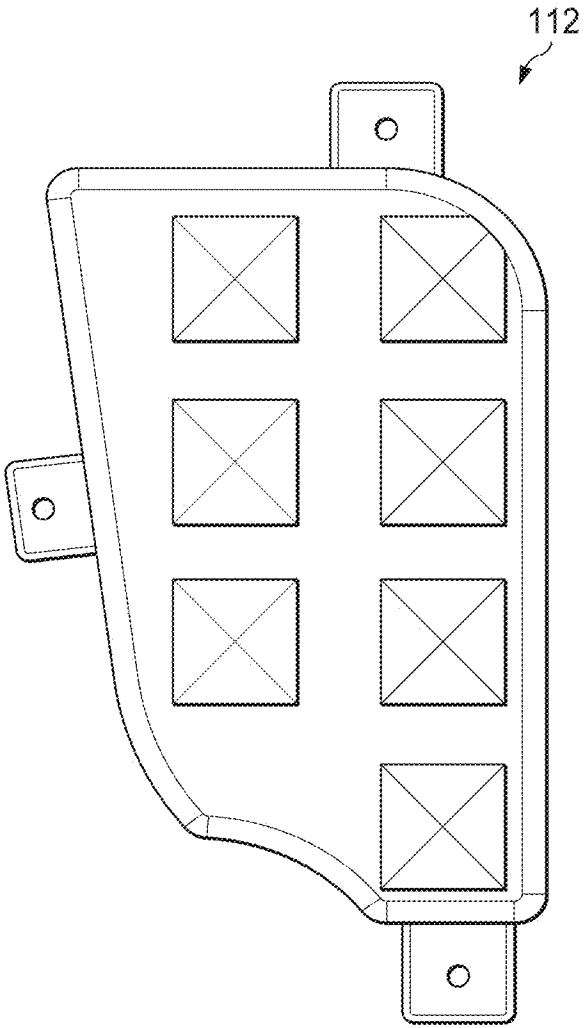
FIG. 16B is a plan view of a front of a right catch plate insert.
Figure 16A:
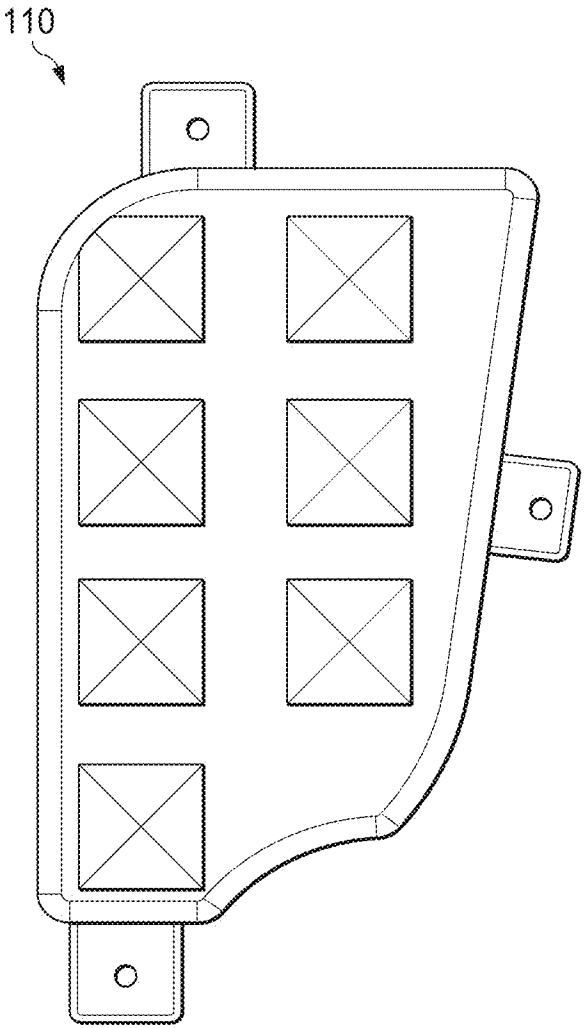
FIG. 16A is a plan view a front of a left catch plate insert.

Pivot ball 150 is located in central orifice 58 of pivot plate 50. Pivot ball 150 preferably defines top hemisphere 152 and bottom hemisphere 154. In one embodiment, top hemisphere 152 and bottom hemisphere 154 are separated by equator 156. Pivot ball 150 preferably defines screw counterbore 158 in communication with top hemisphere 152. Pivot ball 150 preferably defines post counterbore 160 in communication with bottom hemisphere 154 (FIG. 15B). Pivot ball 150 preferably defines axial passageway 162 that extends from screw counterbore 158 to post counterbore 160. Top hemisphere 152 defines top pivot surface 164. Bottom hemisphere 154 defines bottom pivot surface 166 (FIG. 15A). Post counterbore 160 is received on pivot ball post 40 of frame 20. Top pivot surface 164 is in sliding engagement with concave surface 94 of pivot ball rotation member 92 of catch plate 80.

Pivot plate 50 and catch plate 80 define outer assembly 200. Outer assembly 200 is pivotally mounted on frame 20 with resilient spring member 210. Resilient spring member 210 functions to return outer assembly 200 to a neutral position as outer assembly 200 pivots about pivot ball 150. In one embodiment, resilient spring member 210 is comprised of index cord 220. In one embodiment, index cord 220 passes through first upper index cord pass through 32 and second upper index cord pass through 34 of frame 20. Additionally, index cord 220 passes through lower index cord pass through 36 of frame 20 and engages index cord pass through 62 of pivot plate 50 for elastically biasing pivot plate 50 in a downward most orientation about pivot ball 150.

Figure 17:
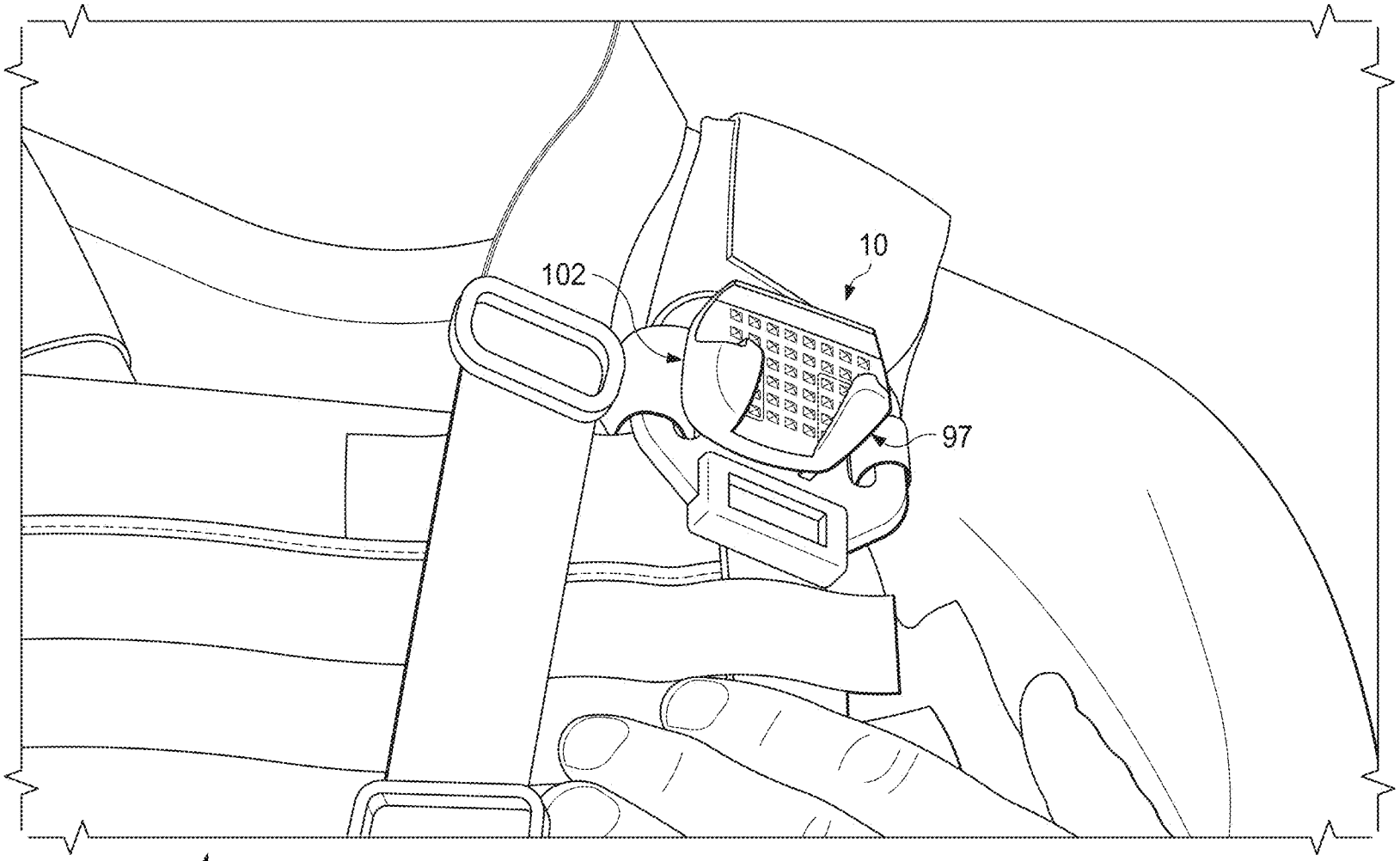
FIG. 17 is an image of the device of the invention attached to a shoulder strap of body armor via a strap with hook and loop fasteners.
Figure 18:
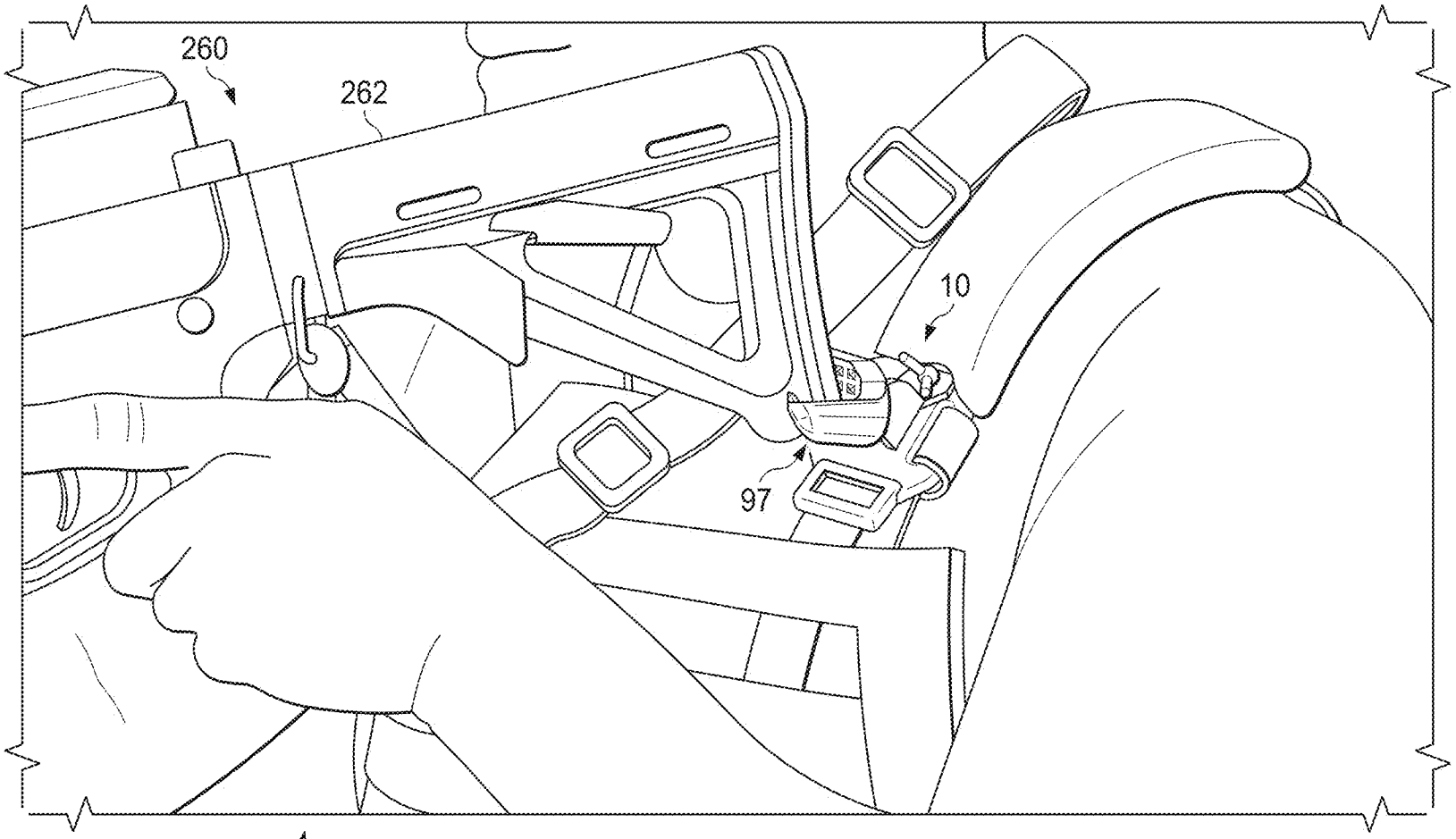
FIG. 18 is an image of a the device of the invention attached to the shoulder strap of FIG. 17 wherein a right buttstock heel hook can be seen engaging the buttstock adjacent to a terminal end of the buttstock.

Referring now to Figures FIGS. 17 and 18, shown is an image of the device or shooting platform 10 of the invention attached to a shoulder strap of body armor or equipment 250 via a strap with hook and loop fasteners. As discussed above, other means of attachment are also possible. Firearm 260 (FIG. 18) has buttstock 262 that is received in device or shooting platform 10 Buttstock 262 defines a terminal end 264. Right buttstock heel hook 97 can be seen engaging buttstock 262 adjacent to terminal end 264 of buttstock 262 for facilitating engagement of shooting platform 10 and buttstock 262.

Although particular embodiments have been described herein, it will be appreciated that the invention is not limited thereto and that many modifications and additions thereto may be made within the scope of the invention. For example, various combinations of the features of the following dependent claims can be made with the features of the independent claims without departing from the scope of the present invention.

It is to be understood that the terms "including", "comprising", "consisting" and grammatical variants thereof do not preclude the addition of one or more components, features, steps, or integers or groups thereof and that the terms are to be construed as specifying components, features, steps or integers.

If the specification or claims refer to "an additional" element, that does not preclude there being more than one of the additional element.

It is to be understood that where the claims or specification refer to "a" or "an" element, such reference is not be construed that there is only one of that element.

It is to be understood that where the specification states that a component, feature, structure, or characteristic "may", "might", "can" or "could" be included, that particular component, feature, structure, or characteristic is not required to be included.

Methods of the present invention may be implemented by performing or completing manually, automatically, or a combination thereof, selected steps or tasks.

The term "method" may refer to manners, means, techniques and procedures for accomplishing a given task including, but not limited to, those manners, means, techniques and procedures either known to, or readily developed from known manners, means, techniques and procedures by practitioners of the art to which the invention belongs.

The term "at least" followed by a number is used herein to denote the start of a range beginning with that number (which may be a ranger having an upper limit or no upper limit, depending on the variable being defined). For example, "at least 1" means 1 or more than 1. The term "at most" followed by a number is used herein to denote the end of a range ending with that number (which may be a range having 1 or 0 as its lower limit, or a range having no lower limit, depending upon the variable being defined). For example, "at most 4" means 4 or less than 4, and "at most 40%" means 40% or less than 40%.

When, in this document, a range is given as "(a first number) to (a second number)" or "(a first number)-(a second number)", this means a range whose lower limit is the first number and whose upper limit is the second number. For example, 25 to 100 should be interpreted to mean a range whose lower limit is 25 and whose upper limit is 100. Additionally, it should be noted that where a range is given, every possible subrange or interval within that range is also specifically intended unless the context indicates to the contrary. For example, if the specification indicates a range of 25 to 100 such range is also intended to include subranges such as 26-100, 27-100, etc., 25-99, 25-98, etc., as well as any other possible combination of lower and upper values within the stated range, e.g., 33-47, 60-97, 41-45, 28-96, etc. Note that integer range values have been used in this paragraph for purposes of illustration only and decimal and fractional values (e.g., 46.7-91.3) should also be understood to be intended as possible subrange endpoints unless specifically excluded.

It should be noted that where reference is made herein to a method comprising two or more defined steps, the defined steps can be carried out in any order or simultaneously (except where context excludes that possibility), and the method can also include one or more other steps which are carried out before any of the defined steps, between two of the defined steps, or after all of the defined steps (except where context excludes that possibility).

Further, it should be noted that terms of approximation (e.g., "about", "substantially", "approximately", etc.) are to be interpreted according to their ordinary and customary meanings as used in the associated art unless indicated otherwise herein. Absent a specific definition within this disclosure, and absent ordinary and customary usage in the associated art, such terms should be interpreted to be plus or minus 10% of the base value.

Thus, the present invention is well adapted to carry out the objects and attain the ends and advantages mentioned above as well as those inherent therein. While the inventive device has been described and illustrated herein by reference to certain preferred embodiments in relation to the drawings attached thereto, various changes and further modifications, apart from those shown or suggested herein, may be made therein by those of ordinary skill in the art, without departing from the spirit of the inventive concept the scope of which is to be determined by the following claims.

What is claimed is:

1. A shooting pocket/platform for stabilizing a firearm comprising:

a frame defining a front side and a rear side, said frame adapted for securing to equipment worn by a shooter;

a pivot plate pivotally mounted with respect to said frame, said pivot plate defining an outer facing side and an inner facing side;

a receiving area for selectively receiving a buttstock of the firearm, said receiving area adapted to pivot with said pivot plate to facilitate directional manipulation of the firearm for aiming the firearm;

wherein said receiving area is defined by at least one of stability walls and a lower buttstock support extending outwardly with respect to said outer facing side of said pivot plate.

2. The device according to claim 1 wherein:

said frame defining strap receiving areas for receiving straps to secure said frame to the equipment worn by the shooter.

3. The device according to claim 1 wherein:

a pivot ball post extends from said front side of said frame, said pivot ball post defining a terminal end for being received in a receptacle of a pivot ball.

4. The device according to claim 1 wherein:

a travel stop extending from said front side of said frame for limiting a range of movement of said pivot plate.

5. The device according to claim 1 wherein:

said pivot plate is secured to said frame;

said inner facing side of said pivot plate defines a first plane;

said pivot plate defining a central orifice:

said pivot plate defining a pivot ball support surrounding said central orifice on said inner facing side, said pivot ball support defining a pivot ball engaging surface.

6. The device according to claim 5 wherein:

said pivot ball engaging surface defining a second plane that is offset from said first plane by 30 to 10 degrees.

7. The device according to claim 5 wherein:

said pivot ball engaging surface defining a second plane that is offset from said first plane by 25 to 15 degrees.

8. The device according to claim 5 wherein:

said pivot ball engaging surface defining a second plane that is offset from said first plane by approximately 20 degrees.

9. The device according to claim 5 further comprising:

a pivot ball located adjacent said central orifice of said pivot plate, said pivot ball defining a top pivot surface and a bottom pivot surface.

10. The device according to claim 9 further comprising:

a catch plate defining an inner facing side:

wherein said inner facing side of said catch plate defines a pivot ball rotation member having a concave surface; and wherein said top pivot surface of said pivot ball in sliding engagement with said pivot ball rotation member of said catch plate.

11. The device according to claim 1 further comprising:

a catch plate defining an outwardly facing side and an inner facing side;

wherein said inner facing side of said catch plate for mating engagement with said outer facing side of said pivot plate.

12. The device according to claim 11 wherein:

said inner facing side of said catch plate defining a pivot ball rotation member having a concave surface.

13. The device according to claim 11 wherein:

said outwardly facing side of said catch plate defining a plurality of buttstock anti-slip features.

14. The device according to claim 11 wherein:

said catch plate having a right buttstock heel hook extending from said outwardly facing side and defining a terminal end, said catch plate having a left buttstock heel hook extending from said outwardly facing side and defining a terminal end.

15. The device according to claim 14 wherein:

said right buttstock heel hook having a right lateral stability wall and a buttstock rest support extending upward from said terminal end of said right buttstock heel hook; and said left buttstock heel hook having a left lateral stability wall and a buttstock rest support extending upward from said terminal end of said left buttstock heel hook.

16. The device according to claim 1 further comprising:

a biasing member for returning said pivot plate to a pre-determined position relative to said frame.

17. The device according to claim 16 wherein:

said biasing member is an index cord passing through at least one index cord passthrough defined by said frame and engaging at least one index cord passthrough defined by said pivot plate for elastically biasing said pivot plate in a pre-determined orientation with respect to said frame about a pivot ball.

18. A shooting pocket/platform for stabilizing a firearm comprising:

a frame defining a front side and a rear side, said frame adapted for securing to equipment worn by a shooter;

a pivot plate pivotally mounted with respect to said frame, said pivot plate defining an outer facing side and an inner facing side;

a receiving area for selectively receiving a buttstock of the firearm, said receiving area adapted to pivot with said pivot plate to facilitate directional manipulation of the firearm for aiming the firearm;

a travel stop extending from said front side of said frame for limiting a range of movement of said pivot plate.

19. A shooting pocket/platform for stabilizing a firearm comprising:

a frame defining a front side and a rear side, said frame adapted for securing to equipment worn by a shooter;

a pivot plate pivotally mounted with respect to said frame, said pivot plate defining an outer facing side and an inner facing side;

a receiving area for selectively receiving a buttstock of the firearm, said receiving area adapted to pivot with said pivot plate to facilitate directional manipulation of the firearm for aiming the firearm;

said inner facing side of said pivot plate defines a first plane;

said pivot plate defining a central orifice;

said pivot plate defining a pivot ball support surrounding said central orifice on said inner facing side, said pivot ball support defining a pivot ball engaging surface;

a pivot ball located adjacent said central orifice of said pivot plate, said pivot ball defining a top pivot surface and a bottom pivot surface;

a catch plate defining an inner facing side;

wherein said inner facing side of said catch plate defines a pivot ball rotation member having a concave surface; and wherein said top pivot surface of said pivot ball in sliding engagement with said pivot ball rotation member of said catch plate.

20. A shooting pocket/platform for stabilizing a firearm comprising:

a frame defining a front side and a rear side, said frame adapted for securing to equipment worn by a shooter;

a pivot plate pivotally mounted with respect to said frame, said pivot plate defining an outer facing side and an inner facing side;

a receiving area for selectively receiving a buttstock of the firearm, said receiving area adapted to pivot with said pivot plate to facilitate directional manipulation of the firearm for aiming the firearm;

a catch plate defining an outwardly facing side and an inner facing side;

wherein said inner facing side of said catch plate for mating engagement with said outer facing side of said pivot plate.

21. The device according to claim 20 wherein:

said inner facing side of said catch plate defining a pivot ball rotation member having a concave surface.

22. The device according to claim 20 wherein:

said outwardly facing side of said catch plate defining a plurality of buttstock anti-slip features.

23. The device according to claim 20 wherein:

said catch plate having a right buttstock heel hook extending from said outwardly facing side and defining a terminal end, said catch plate having a left buttstock heel hook extending from said outwardly facing side and defining a terminal end.

24. A shooting pocket/platform for stabilizing a firearm comprising:

a frame defining a front side and a rear side, said frame adapted for securing to equipment worn by a shooter;

a pivot plate pivotally mounted with respect to said frame, said pivot plate defining an outer facing side and an inner facing side;

a receiving area for selectively receiving a buttstock of the firearm, said receiving area adapted to pivot with said pivot plate to facilitate directional manipulation of the firearm for aiming the firearm;

a biasing member for returning said pivot plate to a pre-determined position relative to said frame.

25. The device according to claim 24 wherein:

said biasing member is an index cord passing through at least one index cord passthrough defined by said frame and engaging at least one index cord passthrough defined by said pivot plate for elastically biasing said pivot plate in a pre-determined orientation with respect to said frame about a pivot member.

* * * * *